US006564724B2

(12) United States Patent
Moberg

(10) Patent No.: US 6,564,724 B2
(45) **Date of Patent: *May 20, 2003**

(54) TRANSPORT DEVICE

(75) Inventor: Thomas Moberg, Motala (SE)

(73) Assignee: Easy AB, Växjö (SE)

( * ) Notice: Subject to any disclaimer, the term of this patent is extended or adjusted under 35 U.S.C. 154(b) by 74 days.

This patent is subject to a terminal disclaimer.

(21) Appl. No.: 09/727,500

(22) Filed: Dec. 4, 2000

(65) Prior Publication Data

US 2001/0025589 A1 Oct. 4, 2001

Related U.S. Application Data

(63) Continuation of application No. 09/402,166, filed as application No. PCT/SE98/00580 on Mar. 30, 1998, now Pat. No. 6,173,658.

(30) Foreign Application Priority Data

Apr. 1, 1997 (SE) ..... 9701190

(51) Int. Cl.[7] ..... B65D 19/00
(52) U.S. Cl. ..... 108/51.3; 108/57.33
(58) Field of Search ..... 108/51.1, 51.3, 108/56.3

(56) References Cited

U.S. PATENT DOCUMENTS 2,446,914 A * 8/1948 Fallert ..... 108/51.3
3,026,078 A * 3/1962 Simkins ..... 108/51.3
3,113,532 A * 12/1963 White ..... 108/51.3
3,659,534 A * 5/1972 Childs ..... 108/51.3
3,911,834 A * 10/1975 Quaintance ..... 108/51.3
3,952,672 A * 4/1976 Gordon et al. ..... 108/51.3
4,563,377 A * 1/1986 Melli ..... 108/51.3
5,285,731 A * 2/1994 McIntyre ..... 108/51.3

FOREIGN PATENT DOCUMENTS

SE 313777 * 8/1969 ..... 108/51.3
SU 372126 * 10/1973 ..... 108/51.3

* cited by examiner

*Primary Examiner*—Lanna Mai
*Assistant Examiner*—Jerry A Anderson
(74) *Attorney, Agent, or Firm*—Kenyon & Kenyon

(57) ABSTRACT

A pallet made up of a first base part which is attached to a second base part. The first base part is formed by a first sheet, which has a first fold line symmetrical to a first sheet center line. The first sheet is further divided by thirteen fold lines on each side of the first fold line. The first sheet, when folded at the fold lines, forms the first base part. The second sheet has seven symmetrical fold lines on each side of a second sheet center line. The second sheet, when folded along the fold lines, forms the second base part. To assemble the pallet, the first sheet is folded along the thirteen lines on each side of and symmetric to the first sheet center line, and on the center line, the second sheet is folded along the seven lines on each side of and symmetric to the second sheet center line, and the folded first sheet is attached to the folded second sheet to form the pallet.

14 Claims, 3 Drawing Sheets

A
1
2
3
4
5
6
7
8
9
10
11
12
13
14
14
13
12
11
10
9
8
7
6
5
4
3
2
1

A1
2
1
4
5
7
8
3
6
9
10
15
11
12
13
14
14
13
12
15
11
10
9
8
7
6
5
4
3
1
2

TRANSPORT DEVICE

CROSS-REFERENCE TO RELATED APPLICATIONS

This application is a continuation of application Ser. No. 09/402,166 filed Mar. 21, 2000, now U.S. Pat. No. 6,173, 658, which is included herein in its entirety by reference thereto, which is a U.S. National Phase application of International Application No. PCT/SE98/00580 filed Mar. 30, 1998, which is a PCT application of Swedish Patent Application No. 9701190-2 filed Apr. 1, 1997.

BACKGROUND OF THE INVENTION

The present invention relates to a pallet for transport and handling of goods with a forklift truck and, particularly, a pallet comprising at least two base parts made of corrugated, waterproof fiber material.

The pallet is an important aid in modem transports and is made in many different ways and designs. A traditional type of pallet is made of wood, which is heavy and contributes to increased transport weight and thereby increased transport costs. Many other pallet designs in different materials, for instance plastic or fiber material has been developed. Several solutions disclose pallets in which more or less complicated details of fiber material, preferably paper, corrugated or plane, are assembled to achieve the desired form and strength.

The pallets according to the Swedish patent applications 450 481, 450 482 and 459 251 disclose designs with three base parts assembled with a number of transverse elements with a circular or rectangular cross-section. The elements are inserted through openings of corresponding shape in the three base parts so the pallet can be lifted with a fork from all sides. The designs are characterized by a large number of details which have to be assembled and by an extensive amount of holes that have to be made in the base parts.

U.S. Pat. No. 3,113,532 discloses a pallet design with one base part folded to a system of channels provided with openings permitting access from all sides. A number of supporting and stiffening elements are fit in between the channels. This pallet also has many details and requires many different operations to be assembled.

U.S. Pat. No. 5,285,731 discloses a pallet with a complicated folding pattern and many details. The pallet is only accessible with a fork from two opposite sides.

U.S. Pat. No. 5,911,834 discloses a pallet comprising a first base part with a great number of punched parties forming inner supports and providing openings for the fork legs. A first base part is enclosed by a second base part keeping the first base part together. The design is complicated and requires many punching and folding operations. A second design has one further element in the center of the first base part making the design even more detailed and complicated to manufacture and assemble.

U.S. Pat. No. 3,952,672 discloses a pallet that comprises a first base part folded around a second base part. This design also has many punched details, which have to be folded in different directions to create supports and channels.

All designs, except for the first three cited, disclose low pallet height which in fact requires less space but at the same time offers a limited bending strength which is unfavorable for their main purpose, namely to carry load. Common to all pallets cited is that cutting and punching give a great wastage, as the basic material cannot be effectively utilized. Many details and complicated procedures both at manufacturing of details and assembling contribute to high production costs. Since the life of the pallets is limited due to the type of material, it is important that they are simple to produce and cheap.

SUMMARY OF THE INVENTION

The object of present invention is to eliminate the disadvantages of the pallets described above and achieve a pallet whose base parts can be made from rolls of corrugated fiber material by just cutting pieces of appropriate length, completely without wastage, fold them to the required shape and assemble them to a pallet accessible from all sides and having a large bending and shearing strength in ail directions.

A pallet according to the invention having the characteristics stated in claim 1 and the subsequent claims achieves this object.

BRIEF DESCRIPTION OF THE DRAWINGS

A preferred embodiment of the invention will now be described with reference to the enclosed drawings on which:

In FIG. 1 is shown the upper side of a first rectangular piece A of preferably corrugated, waterproof fiber material having fiber layers on both sides and the corrugation lengthwise. It is cut to a length, which when folded according to the side view of FIG. 2, forms a first base part A1 with a length corresponding to a pallet of requested size. Since the rectangular piece A is symmetrical to a center line, the same numbering is used on both sides of the center line.

The rectangular piece A is prepared by embossing (solid line means from above and dashed line from underneath) in order to obtain folding notches on the side towards which the material is to be folded. The material is divided into parts 1–14, which after folding give the base part A1 length and width of the pallet in question and a height which in the preferred embodiment corresponds to preferably half the height of the complete pallet.

The folding sequence is described in the table below:

| Part | Folding direction | Folding angle in degrees |
|---|---|---|
| 1 | upwards | 90 |
| 2 | upwards | 90 |
| 3 | upwards | 90 |
| 4 | downwards | 180 |
| 5 | upwards | 90 |
| 6 | upwards | 90 |
| 7 | downwards | 180 |
| 8 | upwards | 90 |
| 9 | upwards | 90 |
| 10 | downwards | 90 |

-continued

| Part | Folding direction | Folding angle in degrees |
|---|---|---|
| 11 | downwards | 90 |
| 12 | upwards | 90 |
| 13 | upwards | 90 |
| 14 | downwards | 180 |

Figure 1:
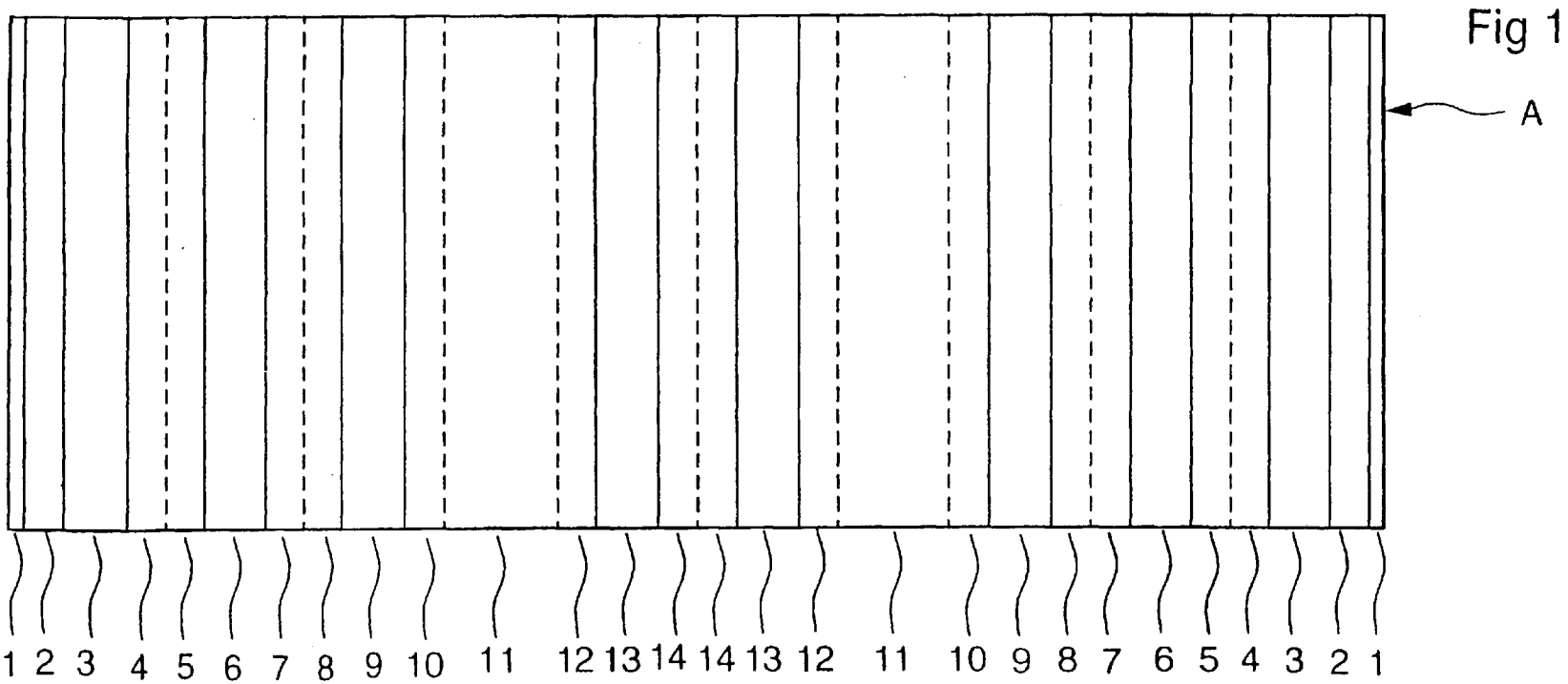
FIG. 1 shows a plane view of the upper side of a first piece of fiber material.
Figure 2:
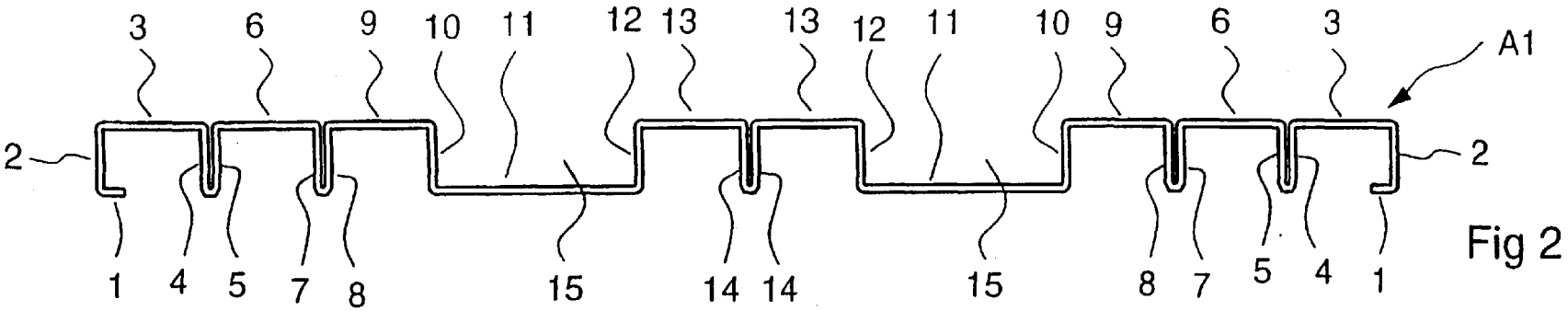
FIG. 2 shows a side view of a first base part, upside down.

After the piece A is folded according to this sequence, from the short sides and inwards, the surfaces between the parts 4 and 5, 7 and 8 and 14 and 14 are glued together. The piece A has now taken the shape of a first base part A1 for a pallet shown upside down in a side view in FIG. 2. The folding operations have formed a number of channels, three at each end and two in the middle. Between the outer and middle channels two spaces 15 are formed. These spaces have width, height and distance to each other permitting a fork of a fork lift truck to be positioned into them.

Figure 3:
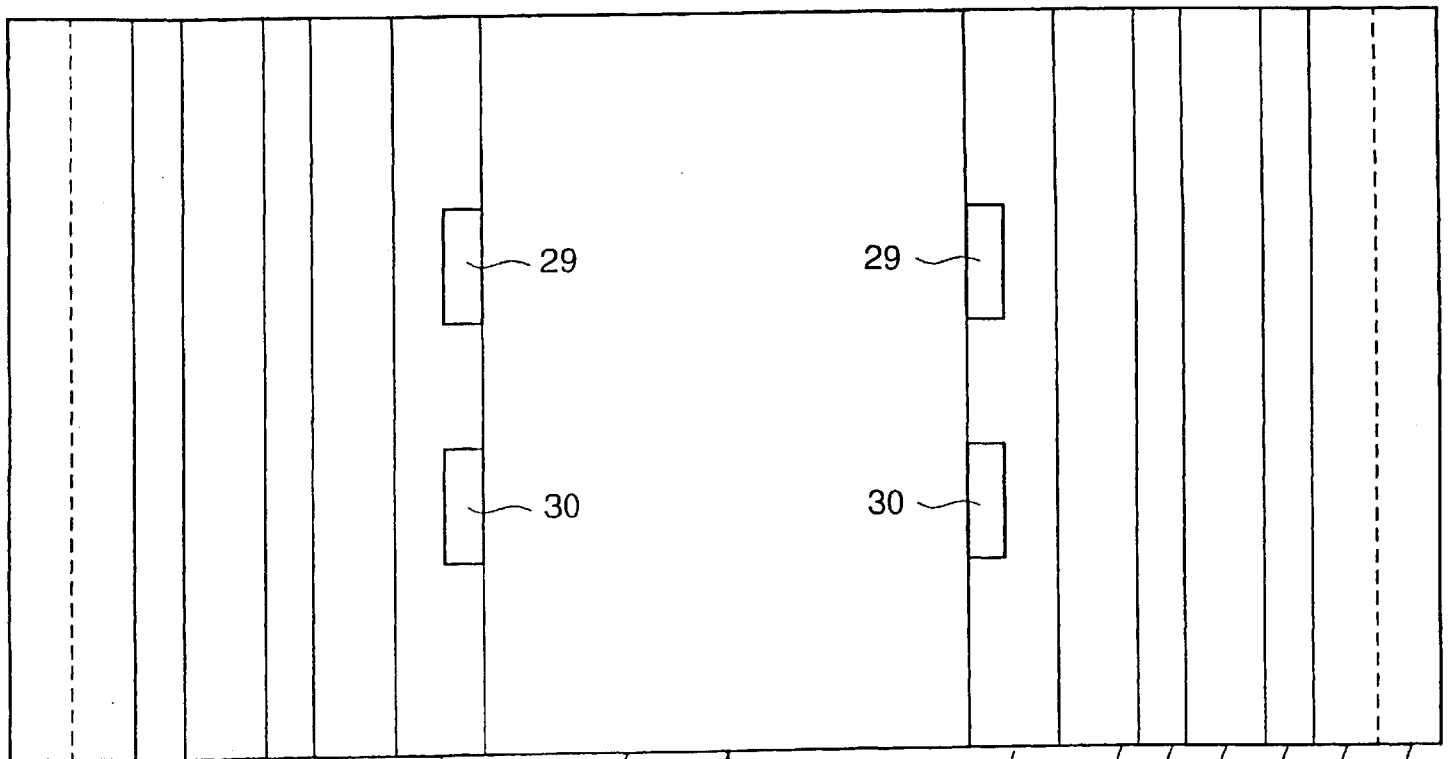
FIG. 3 shows a plane view of the upper side of a second piece of fiber material.
Figure 5:
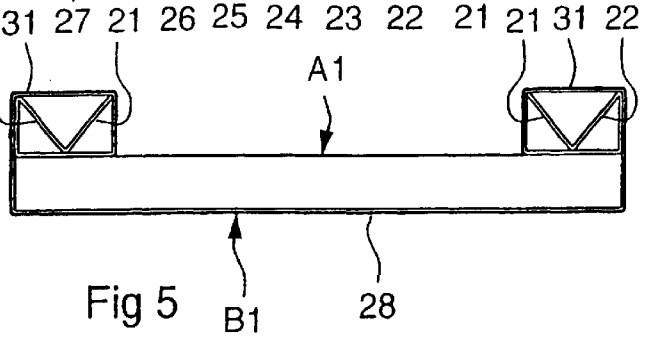
FIG. 5 shows a side view of a second base part joined to the first base part, upside down.

In FIG. 3 is shown a second rectangular piece B made from the same material as the piece A and with the corrugation in the longitudinal direction. It is cut to a length that forms a second base part B1 when folded according to the folding pattern shown in FIG. 3. This rectangular piece is also symmetric to a center line and for which reason the numbers are the same on both sides of the centre line.

The second rectangular piece is treated by embossing in the same way as the first piece to achieve folding notches on the side towards which the material is to be folded. The second piece is divided into parts 21–28 as shown in FIG. 3.

In the parts 27, along the edges closest to the center line and symmetric to the longitudinal center line, openings 29 and 30 are made. The openings have width, height and distance to each other permitting a fork of a fork lift truck to be positioned into them, i.e., they have the same shape and dimensions as the spaces in the first base part A1.

The folding sequence is described in the table below:

| Part | Folding direction | Folding angle in degrees |
|---|---|---|
| 21 | downwards | ca 90 |
| 22 | upwards | ca 135 |
| 23 | upwards | 90 |
| 24 | downwards | 90 |
| 25 | upwards | 90 |
| 26 | upwards | 90 |

After the piece B has been folded according to the above sequence, up to the parts 23, from the short sides and inwards, the surfaces between the parts 23 and 27 are glued together. After the folding sequence has been carried out, the piece B has got the shape according to FIG. 4, which shows a side view of the second base part B1 upside down, where the part 28 is the upper side of the pallet.

Figure 4:
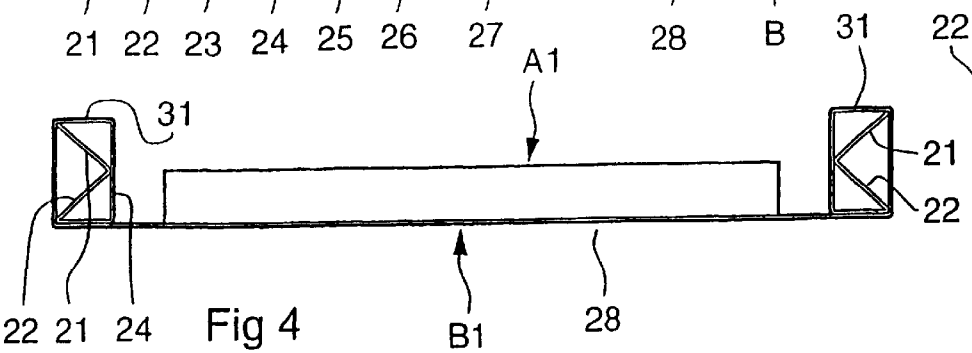
FIG. 4 shows a side view of a second base part in a first stage, upside down.

The under side of part 28 and the parts 24 and 27 of the second base part B1 are covered with glue. The first base part A1 is then placed with the parts 1 and 11 and the points formed by the parts 4, 5 and 7, 8 against the part 28, with the two longitudinal beams 31 outside the long sides of the first base part A1 that the edges and the center lines of the base parts overlap, as shown in FIG. 4. The parts 27 are folded 90° upwards until they contact the edges of the channel openings in the long sides of the first base part A1 and the parts 24 will contact the underside of the parts 3, 6, 9 and 13 of the first base part A1.

Figure 6:
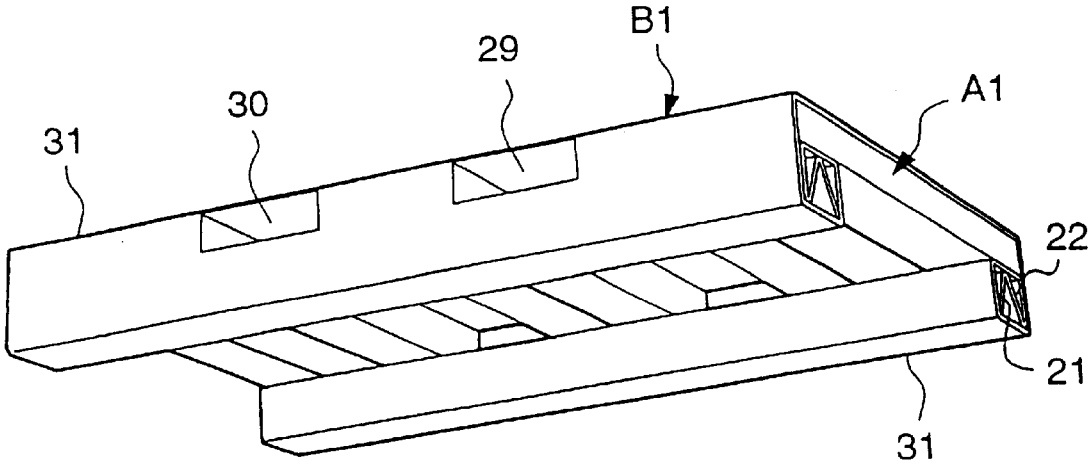
FIG. 6 shows a perspective view of a pallet from below.
Figure 7:
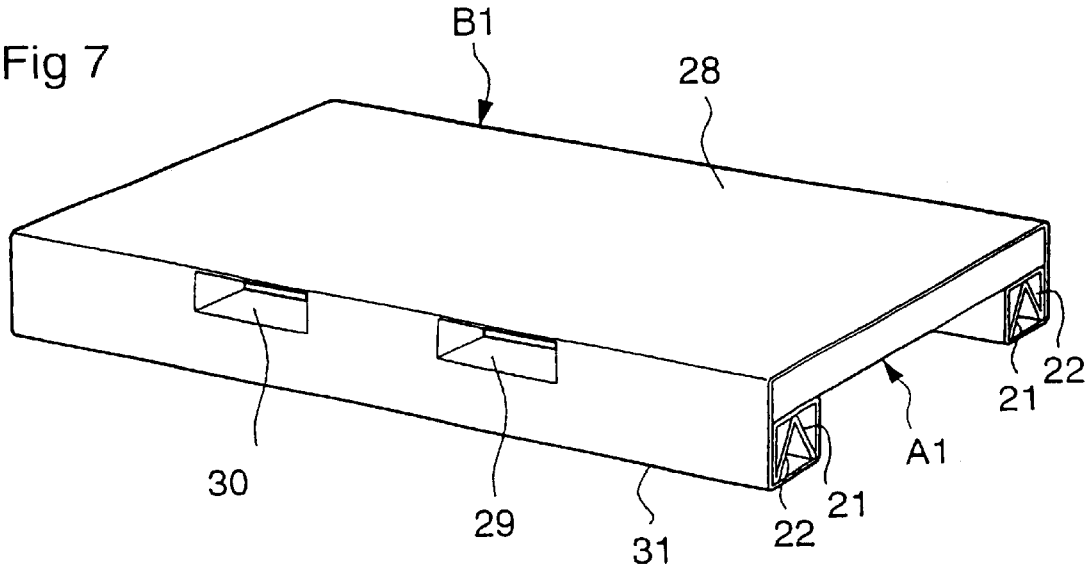
FIG. 7 shows a perspective view of a pallet from above.

The two base parts are fixed in this position until the glue has hardened. The result is a pallet shown in the perspective views in FIGS. 6 and 7.

The open end surfaces at the short sides are provided with a water protecting layer to prevent water to get in through the open cut surfaces in the two longitudinal beams 31 underneath the pallet and in the part 28. The cut surfaces of the openings 29 and 30 and the corresponding surfaces on the other side are also protected.

The pallet according to the invention is produced with a minimum of material wastage. The basic material is preferably a roll of corrugated paper with widths corresponding to the widths of pieces A and B, respectively. The pattern for each piece of material is the simplest possible and the number of operations by machine and hand are few and simple.

The longitudinal beams 31 of the pallet has a high strength regarding bending and shearing forces due to the interior stiffeners formed by the first and second parts 21 and 22. These parts also contribute to a high degree of impact resistance in the lower, edges of the beams, which is very important, as they are the most vulnerable parts of the pallet. The way the two base parts A1 and B1 are assembled provides the upper side of the pallet and thereby the top of the two fork channels for long side lifts, formed by the spaces 15 in the first base part A1, with two layers of corrugated material.

A pallet of the preferred embodiment described above has passed extensive handling and load tests without any remarks.

The weight of the pallet is low, only approximately 5.5 kg, while a pallet made of wood in dry condition weighs approximately 23 kg.

The pallet according to the invention is preferably intended to satisfy the requirements of European standard but can, within the scope of the invention, be made to satisfy other standards regarding shape, size and handling.

What is claimed is:

1. A pallet, comprising:

a first sheet, the first sheet including a first fold line along a first sheet center line, the first sheet being further divided by thirteen fold lines on each side of the first fold line, the first sheet, when folded at the fold lines, forms a first base part; and a second sheet, the second sheet including seven symmetrical fold lines on each side of a second sheet center line, the second sheet, when folded along the fold lines, forms a second base part;

wherein the first base part is attached to the second base part to form the pallet, and the first base part includes three adjacent channels with rectangular cross-section at each end with a height approximately equal to half the height of the pallet, adjacent channels on each side of the first sheet center line with the same rectangular cross-section and height as the three adjacent channels, and a space on each side of the first sheet center line located between the three adjacent channels and the adjacent channel, each space configured to permit positioning of a fork on a fork lift truck in the space.

2. The pallet of claim 1, wherein the first and second sheets are formed from a corrugated fiber material.

3. The pallet of claim 1, wherein a distance between two inner most fold lines on either side of the second sheet center line is equal to the width of the first base part.

4. The pallet of claim 1, wherein the second sheet further includes two opposing pairs of rectangular openings with height and length equal to the spaces in the first base part, one pair of rectangular openings being positioned on one of the two opposing inner most fold lines and the other pair of rectangular openings being positioned on the other of the two opposing inner most fold lines.

5. The pallet of claim 1, wherein the second base part comprises longitudinal beams at each end, the longitudinal beams having interior stiffeners formed by folding along the remaining fold lines.

6. The pallet of claim 1, wherein the first base part is attached to the second base part to form the pallet by aligning longitudinal beams located at each end of the second base part under opposing long sides of the first base part and an inner most part of the second base part outside the opposing long sides so that edges of the first and second base parts coincide, and a plurality of rectangular openings in the second base part coincide with the spaces in the first base part and the longitudinal beams are in contact with an under side of each of the channels of the first base part and support the pallet, and contacting surfaces and contacting points within and between the first base part and the second base part are glued together.

7. The pallet of claim 1, wherein portions of the first sheet which are in contact with other portions of the first sheet are glued together.

8. The pallet of claim 1, wherein the first and second sheets and all open cut surfaces are coated with waterproofing layers.

9. A pallet, comprising:

a first base part, the first base part being formed from a first sheet of fold-able material and including:

three adjacent channels with rectangular cross-section at each end of the first base part with a height approximately equal to half the height of the pallet;

two adjacent channels with the same rectangular cross-section and height as the three adjacent channels, the two channels located one each on each side of a first sheet center line;

a space located between the three adjacent channels and two adjacent channels on each side of the first sheet center line;

a second base part, the second base part being formed from a second sheet of fold-able material; and the first base part being fixedly attached to the second base part to form the pallet.

10. The pallet of claim 9, wherein openings to each of the three adjacent channels and two adjacent channels occur on a first side of the first base part.

11. The pallet of claim 9, wherein openings to each of the spaces occur on a second side of the first base part.

12. The pallet of claim 9, wherein openings to each of the three adjacent channels and two adjacent channels are oriented to a bottom side of the second base part.

13. The pallet of claim 9, wherein each space is configured to permit positioning of a fork on a fork lift truck in the space.

14. The pallet of claim 9, wherein the first sheet and the second sheet of fold-able material is a corrugated fiber material.

* * * * *

UNITED STATES PATENT AND TRADEMARK OFFICE

CERTIFICATE OF CORRECTION

PATENT NO. : 6,564,724 B2
DATED : May 20, 2003
INVENTOR(S) : Thomas Moberg

It is certified that error appears in the above-identified patent and that said Letters Patent is hereby corrected as shown below:

Column 1,
Line 19, change “modem” to -- modern --

Column 2,
Line 34, change “below;” to -- below; and --
Line 35, change “above;” to -- above. --

Column 3,
Line 26, change “centre” to -- center --

Signed and Sealed this

Ninth Day of March, 2004

JON W. DUDAS
*Acting Director of the United States Patent and Trademark Office*